US012044479B2

(12) United States Patent
Ma et al.

(10) Patent No.: US 12,044,479 B2
(45) Date of Patent: Jul. 23, 2024

(54) HEAT EXCHANGER

(71) Applicant: ZHEJIANG DUNAN ARTIFICIAL ENVIRONMENT CO., LTD., Zhejiang (CN)

(72) Inventors: Wenyong Ma, Zhejiang (CN); Wenjian Wei, Zhejiang (CN)

(73) Assignee: Zhejiang DunAn Artificial EnvironmentCo., Ltd., Zhejiang (CN)

( * ) Notice: Subject to any disclaimer, the term of this patent is extended or adjusted under 35 U.S.C. 154(b) by 266 days.

(21) Appl. No.: 17/763,222

(22) PCT Filed: Aug. 12, 2020

(86) PCT No.: PCT/CN2020/108580
§ 371 (c)(1),
(2) Date: Mar. 24, 2022

(87) PCT Pub. No.: WO2021/082618
PCT Pub. Date: May 6, 2021

(65) Prior Publication Data

US 2022/0357107 A1 Nov. 10, 2022

(30) Foreign Application Priority Data

Oct. 29, 2019 (CN) ..... 201911040325.1

(51) Int. Cl.
*F28D 1/053* (2006.01)
*F24F 13/30* (2006.01)
(Continued)

(52) U.S. Cl.
CPC ..... *F28D 1/053* (2013.01); *F24F 13/30* (2013.01); *F25B 39/00* (2013.01); *F28F 9/26* (2013.01)

(58) Field of Classification Search
CPC .. F28D 1/053; F28D 1/05308; F28D 1/05316; F28D 1/05325; F28D 1/05358;
(Continued)

(56) References Cited

U.S. PATENT DOCUMENTS 5,279,360 A * 1/1994 Hughes ..... F28F 9/0243 29/890.07
5,529,116 A * 6/1996 Sasaki ..... F28D 1/0435 165/145
(Continued)

FOREIGN PATENT DOCUMENTS

CN 101788213 A 7/2010
CN 104110977 A 10/2014
(Continued)

*Primary Examiner* — Tho V Duong
(74) *Attorney, Agent, or Firm* — Samson G. Yu

(57) ABSTRACT

Some embodiments of the present disclosure provide a heat exchanger, including: at least three heat exchange tube groups, herein the heat exchange tube groups are communicated in sequence, and at least two heat exchange tube groups are superposed mutually along a direction in which a heat exchange airflow flows, a medium sequentially flows through each heat exchange tube group and forms a U-shaped trajectory; an intermediate adapter portion, herein at least two heat exchange tube groups are communicated with each other by means of the intermediate adapter portion, the intermediate adapter portion includes at least two adapters and an adapter tube communicated with the two adjacent adapters, herein the adapter is composed of a first plate and a second plate, the adapter tube is an extrusion-formed flat tube, and a width direction of the adapter tube is perpendicular to a width direction of the heat exchange tube groups.

14 Claims, 5 Drawing Sheets

(51) Int. Cl.
*F25B 39/00* (2006.01)
*F28F 9/26* (2006.01)

(58) Field of Classification Search
CPC ..... F28D 1/05366; F28D 1/05375; F28D 1/0426; F25B 2500/09; F28F 9/26; F28F 9/268
See application file for complete search history.

(56) References Cited

U.S. PATENT DOCUMENTS

| | | | | |
|---|---|---|---|---|
| 6,745,827 | B2 * | 6/2004 | Lee | F28F 1/022 165/175 |
| 8,776,873 | B2 * | 7/2014 | Mross | F28F 9/0214 165/173 |
| 9,671,176 | B2 * | 6/2017 | Johnson | F28D 1/0435 |
| 10,584,921 | B2 * | 3/2020 | Steinbach | B21D 53/085 |
| 2007/0193731 | A1 | 8/2007 | Lamich et al. | |
| 2013/0240186 | A1 * | 9/2013 | Taras | F28D 1/05358 165/146 |
| 2019/0154342 | A1 * | 5/2019 | Jin | F28D 1/0443 |

FOREIGN PATENT DOCUMENTS

| | | | |
|---|---|---|---|
| CN | 104180705 | A | 12/2014 |
| CN | 107560484 | A | 1/2018 |
| CN | 107764082 | A | 3/2018 |
| CN | 211146969 | | 7/2020 |
| JP | 10160382 | A | 6/1998 |
| JP | 12012032089 | A | 2/2012 |

* cited by examiner

HEAT EXCHANGER

CROSS-REFERENCE TO RELATED APPLICATION

The present disclosure claims priority to Chinese Patent Application No. 201911040325.1, filed on Oct. 29, 2019 and entitled "Heat Exchanger", the contents of which are hereby incorporated by reference in its entirety.

TECHNICAL FIELD

The present application relates to a technical field of heat exchangers, in particular to a heat exchanger.

BACKGROUND

A micro-channel A-type heat exchanger is widely used in air conditioners such as a household appliance and an air duct machine because of the advantages of drainage, compactness, high efficiency and the like. The heat exchange effect of the existing A-type heat exchanger is still unsatisfactory, and can not satisfy the use requirements of users.

SUMMARY

Some embodiments of the present application provide a heat exchanger, as to solve a problem that an A-type heat exchanger in a technology known to inventors can not satisfy the use requirements.

In order to achieve the above purpose, some embodiments of the present application provide a heat exchanger, including: at least three heat exchange tube groups, wherein the heat exchange tube groups are communicated in sequence, and at least two heat exchange tube groups of the at least three heat exchange tube groups are superposed mutually along a direction in which a heat exchange airflow flows, a medium sequentially flows through each heat exchange tube group and forms a U-shaped trajectory; an intermediate adapter portion, wherein the at least two heat exchange tube groups are communicated with each other by the intermediate adapter portion, the intermediate adapter portion includes at least two adapters and an adapter tube communicated with the two adjacent adapters, wherein each adapter include a first plate and a second plate, the adapter tube is an extrusion-formed flat tube, and a width direction of the adapter tube is perpendicular to a width direction of the heat exchange tube groups; and an end adapter portion, herein the end adapter portion is located at an end of heat exchange tube groups which are mutually superposed away from the intermediate adapter portion, and the heat exchange tube groups which are mutually superposed are communicated with each other by the end adapter portion.

In some embodiments, the at least two adapters are respectively connected with mutually close ends of the two heat exchange tube groups communicated by the intermediate adapter portion.

In some embodiments, the first plate has a plurality of first convex hulls, and each of the plurality of the first convex hulls has a through hole; and the second plate has a plurality of first slots, the first plate fits the second plate, the first convex hulls and the second plate are enclosed into a plurality of mutually separated adapter cavities, the adapter tube is communicated with a corresponding adapter cavities through the through holes, and each heat exchange tube group is communicated with a corresponding the adapter cavity through the first slots.

In some embodiments, each of the at least three heat exchange tube groups include a plurality of heat exchange tubes arranged in sequence, lengths of the first plate and the second plate extend along an arrangement direction of the heat exchange tubes, at least part of the first slots are arranged along a length direction of the first plate and communicated with heat exchange tubes in a same heat exchange tube group of the at least three heat exchange tube groups, and the adapter cavities are disposed corresponding to at least one of first slots arranged along the length direction of the first plate.

In some embodiments, an end of the heat exchange tube groups which are mutually superposed close to the intermediate adapter portion is connected with a same adapter, widths of the first plate and the second plate extend along a superposition direction of the heat exchange tube groups, at least part of the plurality of first slots are arranged along a width direction of the first plate, and first slots arranged along the width direction of the first plate corresponds to one adapter cavity respectively.

In some embodiments, the adapter tube is a wide flat tube and there is a plurality of the adapter tubes, and the adapter tubes and the plurality of adapter cavities are arranged in one-to-one correspondence.

In some embodiments, the adapter tube has a plurality of channels, and the plurality of channels of a same adapter tube is communicated with a same adapter cavity.

In some embodiments, the end adapter portion includes: a third plate, wherein the third plate has a plurality of second convex hulls; and a fourth plate, herein the fourth plate has a plurality of second slots, the third plate fits the fourth plate, the second convex hulls and the fourth plate are enclosed into a plurality of communication cavities, the heat exchange tube groups which are mutually superposed are communicated with the communication cavities through the second slots, widths of the third plate and the fourth plate extend along a superposition direction of the heat exchange tube groups, at least part of the plurality of second slots are arranged along a width direction of the third plate, and second slots arranged along the width direction of the third plate corresponds to a same communication cavity.

In some embodiments, the heat exchanger further includes a plurality of side plates, two side plates are respectively arranged above and below each heat exchange tube group, and the two side plates, one end adapter portion and one intermediate adapter portion are enclosed together into an accommodating area for accommodating heat exchange tube groups.

In some embodiments, the heat exchanger further includes: a plurality of current collector tubes; an inlet tube; and an outlet tube, wherein the inlet tube and the outlet tube are respectively communicated with one heat exchange tube group through the plurality of current collector tubes.

In some embodiments, the plurality of current collector tubes, the inlet tube and the outlet tube are located on a same side of the heat exchanger, and located on a side of the heat exchanger away from the end adapter portion.

In some embodiments, all the at least three heat exchange tube groups include: a first heat exchange tube group; a second heat exchange tube group; a third heat exchange tube group; and a fourth heat exchange tube group, herein the first heat exchange tube group, the second heat exchange tube group, the third heat exchange tube group and the fourth heat exchange tube group are communicated in sequence, between the first heat exchange tube group and the fourth heat exchange tube group and between the second heat exchange tube group and the third heat exchange tube group, they are mutually superposed along the direction in which the airflow flows, and between the first heat exchange tube group and the second heat exchange tube group and between the third heat exchange tube group and the fourth heat exchange tube group, they are respectively communicated by the intermediate adapter portion.

In some embodiments, along a length direction of the heat exchange tube groups, a length of an intermediate adapter portion for communicating the first heat exchange tube group and the second heat exchange tube group is greater than a length of an intermediate adapter portion for communicating third heat exchange tube group and the fourth heat exchange tube group.

In some embodiments, the adapter tube is bent, and the two heat exchange tube groups communicated by the intermediate adapter portion have an A-shaped structure.

A technical scheme of the present application is applied, by superposing the heat exchange tube groups, a cold airflow can be more fully exchanged with the medium in the heat exchange tube groups, as to improve the heat exchange performance of the heat exchanger. In addition, the intermediate adapter portion and the end adapter portion are arranged to communicate the heat exchange tube groups mutually, and the intermediate adapter portion can be bent into the A-type structure, so that the heat exchanger has the advantages of the A-type structure, such as drainage, compactness and high efficiency, and the heat exchanger can satisfy the use requirements of users.

BRIEF DESCRIPTION OF THE DRAWINGS

Drawings of the description for constituting a part of the present application are used to provide further understanding of the present application, and schematic embodiments of the present application and descriptions thereof are used to explain the present application, and do not constitute improper limitation to the present application. In the drawings.

Figure 1:
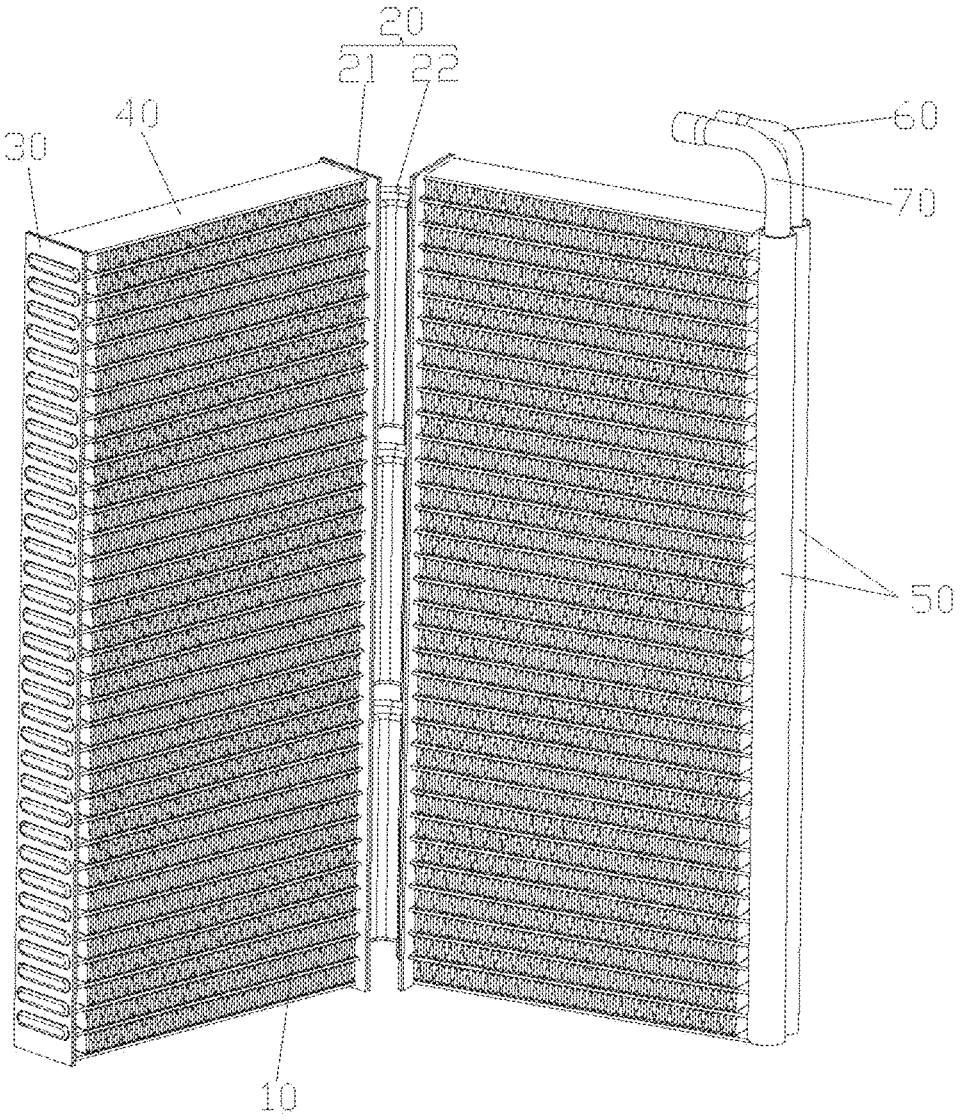
FIG. 1 illustrates a structure schematic diagram of a heat exchanger of some embodiments in the present application.

Herein, the above drawings include the following reference signs:

10. Heat exchange tube group; 11. First heat exchange tube group; 12. Second heat exchange tube group; 13. Third heat exchange tube group; 14. Fourth heat exchange tube group; 20. Intermediate adapter portion; 21. Adapter; 211. First plate; 2111. First convex hull; 212. Second plate; 2121. First slot; 22. Adapter tube; 30. End adapter portion; 31. Third plate; 311. Second convex hull; 32. Fourth plate; 321. Second slot; 40. Side plate; 50. Current collector tube; 60. Inlet tube; and 70. Outlet tube.

DETAILED DESCRIPTION OF THE EMBODIMENTS

It should be noted that embodiments in the present application and features of the embodiments may be combined with each other in the case without conflicting. The present application is described in detail below with reference to the drawings and in combination with the embodiments.

In order to solve a problem that an A-type heat exchanger in an existing technology can not satisfy the use requirements, some embodiments of the present application provide a heat exchanger.

A heat exchanger as shown in FIG. 1 to FIG. 12 includes at least three heat exchange tube groups 10, an intermediate adapter portion 20 and an end adapter portion 30, the heat exchange tube groups 10 are communicated in sequence, and at least two heat exchange tube groups 10 of the at least three heat exchange tube groups are superposed mutually along a direction in which a heat exchange airflow flows, a medium flows sequentially through each heat exchange tube group 10 and forms a U-shaped trajectory; the at least two heat exchange tube groups 10 are mutually communicated by the intermediate adapter portion 20, the intermediate adapter portion 20 includes at least two adapters 21 and an adapter tube 22 communicated with the two adjacent adapters 21, wherein the adapter 21 include a first plate 211 and a second plate 212, the adapter tube 22 is an extrusion-formed flat tube, and a width direction of the adapter tube 22 is perpendicular to a width direction of the heat exchange tube groups 10; and the end adapter portion 30 is located at an end of the heat exchange tube groups 10 which are mutually superposed away from the intermediate adapter portion 20, and the heat exchange tube groups 10 which are mutually superposed are communicated by the end adapter portion 30.

In some embodiments, by superposing the heat exchange tube groups 10, a cold airflow may be more fully exchanged with the medium in the heat exchange tube groups 10, as to improve the heat exchange performance of the heat exchanger. In addition, the intermediate adapter portion 20 and the end adapter portion 30 are arranged to communicate the heat exchange tube groups 10 mutually, and the intermediate adapter portion 20 can be bent into the A-type structure, so that the heat exchanger has the advantages of the A-type structure, such as drainage, compactness and high efficiency, and the heat exchanger can satisfy the use requirements of users.

Figure 3:
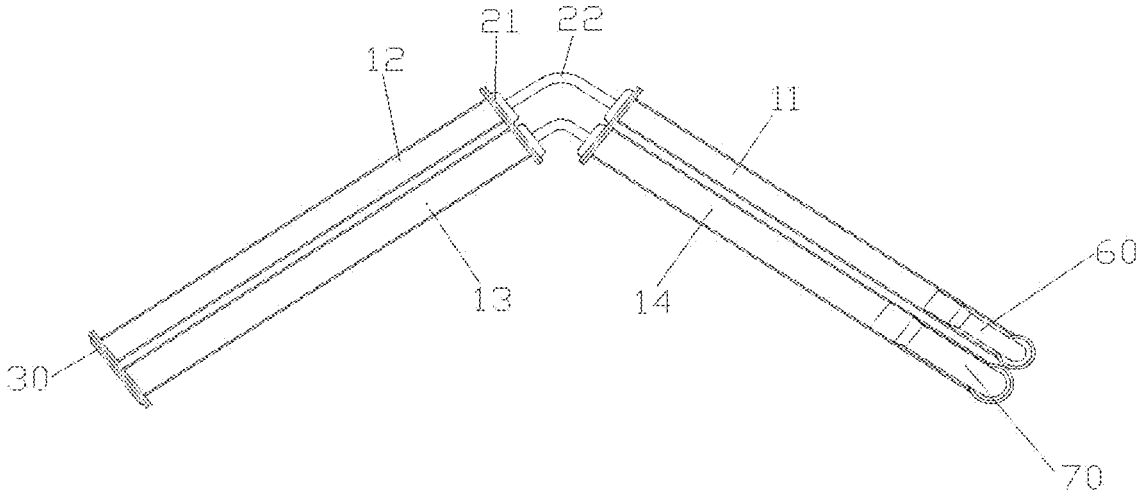
FIG. 3 illustrates a top view of the heat exchanger in FIG. 1.
Figure 4:
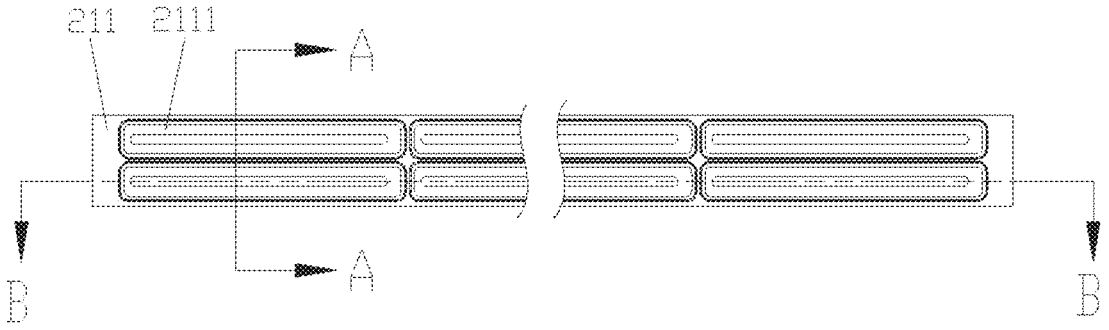
FIG. 4 illustrates a structure schematic diagram of an intermediate adapter portion in FIG. 1.
Figure 5:
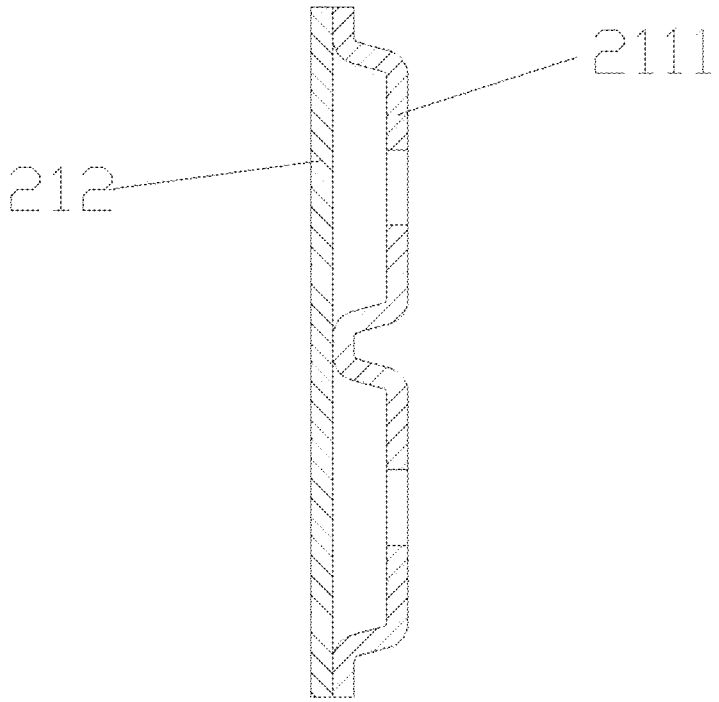
FIG. 5 illustrates a sectional view along an A-A direction in FIG. 4.
Figure 6:
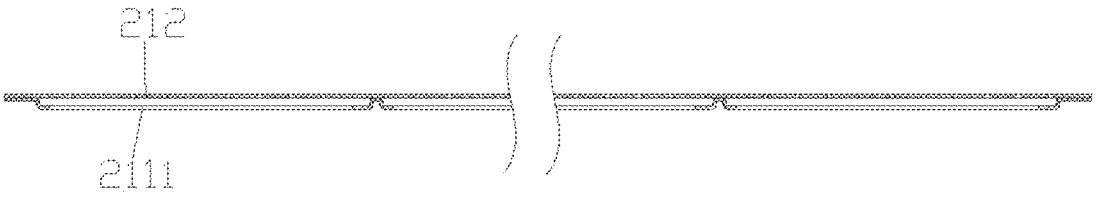
FIG. 6 illustrates a sectional view along a B-B direction in FIG. 4.
Figure 7:
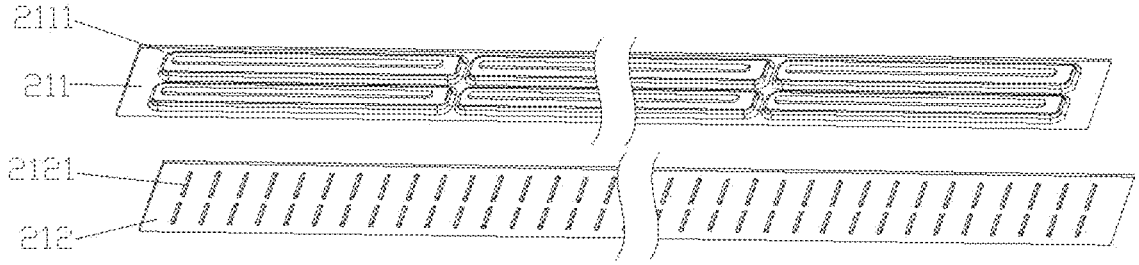
FIG. 7 illustrates an exploded view of the intermediate adapter portion in FIG. 4.
Figure 8:
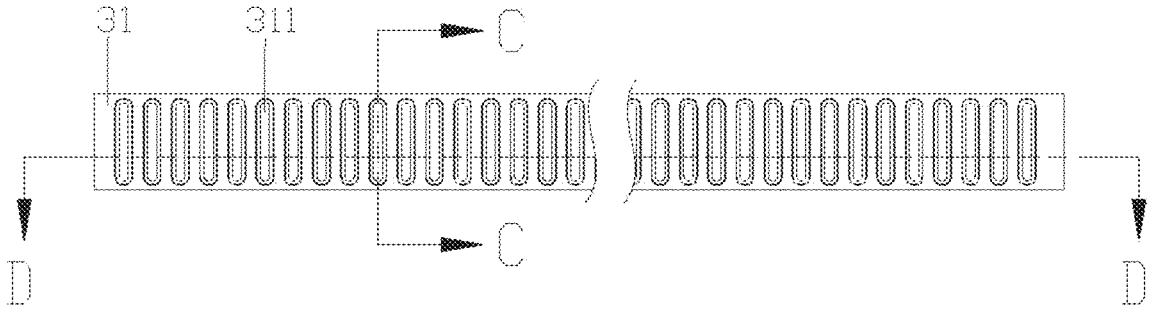
FIG. 8 illustrates a structure schematic diagram of an end adapter portion in FIG. 1.
Figure 9:
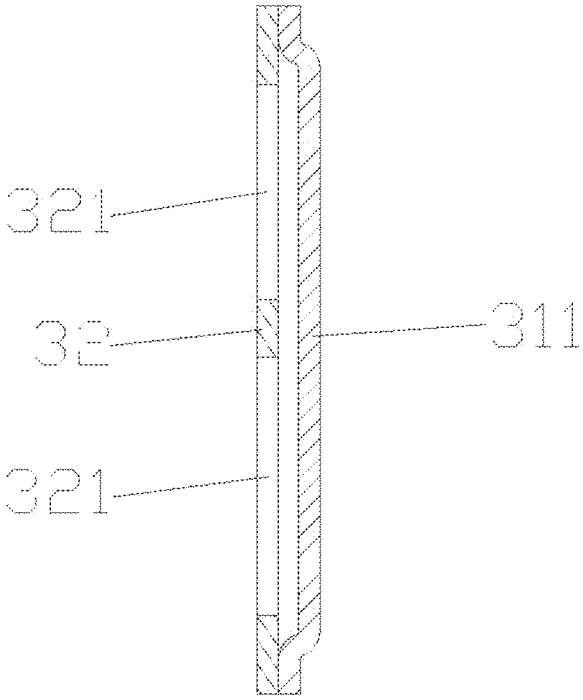
FIG. 9 illustrates a structure schematic diagram along a C-C direction in FIG. 8.
Figure 10:
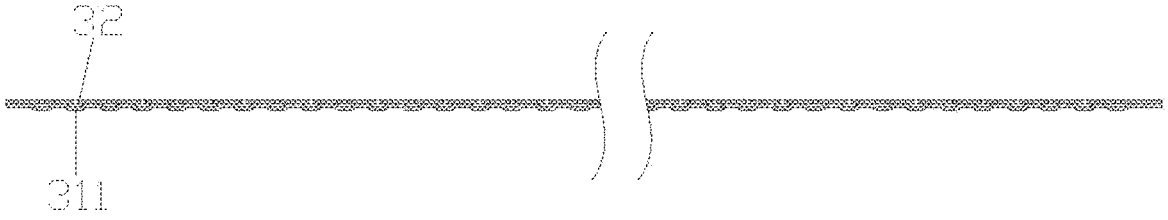
FIG. 10 illustrates a structure schematic diagram along a D-D direction in FIG. 8.
Figure 11:
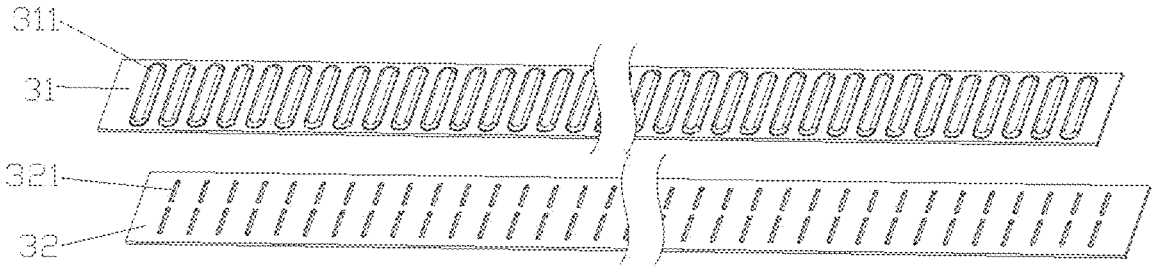
FIG. 11 illustrates an exploded view of the end adapter portion in FIG. 8.

In some embodiments, four heat exchange tube groups 10 are disposed as an example for description. As shown in FIG. 3, the four heat exchange tube groups 10 are a first heat exchange tube group 11, a second heat exchange tube group 12, a third heat exchange tube group 13 and a fourth heat exchange tube group 14, and between the first heat exchange tube group 11 and the fourth heat exchange tube group 14 and between the second heat exchange tube group 12 and the third heat exchange tube group 13, they are mutually superposed along a direction in which an airflow flows, between the first heat exchange tube group 11 and the second heat exchange tube group 12 and between the third heat exchange tube group 13 and the fourth heat exchange tube group 14, they are communicated by the intermediate adapter portion 20, and the medium flows sequentially through the first heat exchange tube group 11, the second heat exchange tube group 12, the third heat exchange tube group 13 and the fourth heat exchange tube group 14 to complete heat exchange and discharge. Certainly, a number of the heat exchange tube groups 10 can be increased or decreased according to the requirements, and a connection mode thereof can also be changed accordingly according to the requirements.

Figure 2:
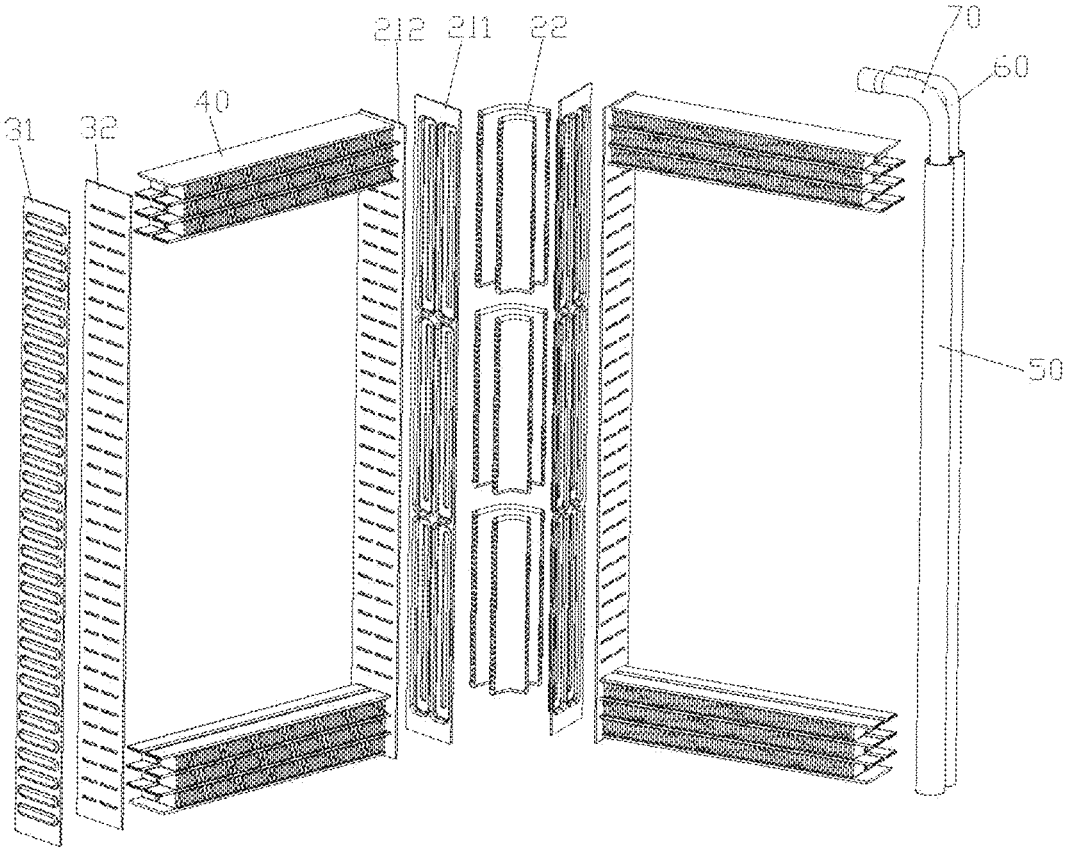
FIG. 2 illustrates an exploded view of the heat exchanger in FIG. 1.

As shown in FIG. 1 to FIG. 3, at least two adapters 21 are respectively connected with the mutually close ends of the two heat exchange tube groups 10 communicated the intermediate adapter portion 20; and the adapter tube 22 is bent, two ends of the adapter tube 22 are respectively connected with the two adapters 21, and the adapters 21 are conducted, so that the two heat exchange tube groups 10 communicated by the intermediate adapter portion 20 have the A-type structure.

Specifically, this embodiment is provided with two adapters 21, one of the adapters 21 is connected with the first heat exchange tube group 11 and the fourth heat exchange tube group 14, and the other adapter 21 is connected with the second heat exchange tube group 12 and the third heat exchange tube group 13. It should be noted that between the first heat exchange tube group 11 and the fourth heat exchange tube group 14 and between the second heat exchange tube group 12 and the third heat exchange tube group 13, the adapter 21 only plays a role of connection and fixation, and it do not conduct the two portions. The two adapters 21 are communicated through the adapter tube 22, the adapter tube 22 itself is bent at a certain angle, the specific size is determined according to the requirements, and the bending angle of the adapter tube 22 basically also determines the specific shape of the A-type structure. Certainly, the more adapters 21 can be arranged according to the requirements, and the first heat exchange tube group 11, the second heat exchange tube group 12, the third heat exchange tube group 13 and the fourth heat exchange tube group 14 are respectively connected with one adapter 21 accordingly. In some embodiments, the adaptor tube 22 is arranged as a straight tube without being bent.

As shown in FIG. 4 to FIG. 7, the first plate 211 of the adapter 21 of this embodiment has a plurality of first convex hulls 2111, and each of the plurality of first convex hulls 2111 has a through hole; and the second plate 212 has a plurality of first slots 2121, while the first plate 211 fits the second plate 212 together, the first convex hulls 2111 and the second plate 212 are enclosed into a plurality of mutually separated adapter cavities, the first slot 2121 is a channel communicated with the adapter cavity and the heat exchange tube group 10, the adapter tube 22 is communicated with the adapter cavity through the through hole, and the heat exchange tube group 10 is communicated with the adapter cavity through the first slot 2121. In this way, the medium in the first heat exchange tube group 11 enters the second heat exchange tube group 12 after passing through the adapter cavity of one adapter 21, the adapter tube 22 and the adapter cavity of the other adapter 21, and a process of the medium in the third heat exchange tube group 13 entering the fourth heat exchange tube group 14 is the same.

It should be noted that the adapter cavity on the adapter 21 in this embodiment only covers a plurality of the heat exchange tubes in the same heat exchange tube group 10 at the same time, but do not cover the heat exchange tubes in the different heat exchange tube groups 10. In other words, some of the heat exchange tubes in the first heat exchange tube group 11 are communicated with the same adapter cavity, as to achieve the mutual communication through the adapter cavity on the adapter 21. Between two heat exchange tube groups 10 which are superposed, namely the heat exchange tubes in the first heat exchange tube group 11 and the heat exchange tubes in the fourth heat exchange tube group 14 can not be communicated with the same adapter cavity. In this way, the medium flows through the second heat exchange tube group 12 and the third heat exchange tube group 13, and do not flow directly from the first heat exchange tube group 11 to the fourth heat exchange tube group 14, as to guarantee the heat exchange effect of the heat exchanger.

In some embodiments, the heat exchange tube group 10 includes a plurality of heat exchange tubes arranged in sequence. In this embodiment, the longitudinal arrangement of the heat exchange tubes is taken as an example, the lengths of the first plate 211 and the second plate 212 extend along an arrangement direction of the heat exchange tubes, and the widths of the first plate 211 and the second plate 212 extends along a superposition direction of the heat exchange tube groups 10, namely a length direction is longitudinal and a width direction is horizontal, and at least part of the first slots 2121 are arranged along the length direction of the first plate 211 and at least part of the first slots 2121 are arranged along the width direction of the first plate 211, namely there is a plurality of rows and columns of the first slots 2121. This embodiment is provided with two columns of the first slots 2121, the first slots 2121 in each column are communicated with the heat exchange tubes in the same heat exchange tube group 10, the two columns of the first slots 2121 are respectively communicated with the heat exchange tubes in the two heat exchange tube groups 10, and the adapter cavity is arranged corresponding to at least one of the first slots 2121 arranged along the length direction of the first plate 211, namely the slots in the same column correspond to the adapter cavities one to one, or have many-one correspondence, it only needs to achieve a communication function, and each of the first slots 2121 arranged along the width direction of the first plate 211 corresponds to one adapter cavity respectively, namely the two columns of the first slots 2121 correspond to the respective adapter cavity respectively, it can not correspond to the same adapter cavity. In this way, the adapter 21 can be avoided from being directly communicated between the first heat exchange tube group 11 and the fourth heat exchange tube group 14. In this embodiment, each adapter 21 is provided with six adapter cavities, the six adapter cavities are divided into two columns, and three adapter cavities in each column are arranged longitudinally. Certainly, the specific setting number can be changed correspondingly according to the heat exchange tube groups 10.

Figure 12:
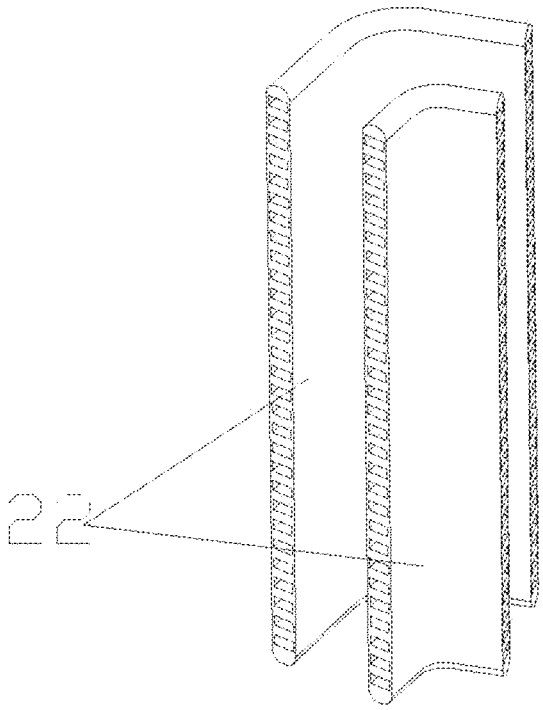
FIG. 12 illustrates a structure schematic diagram of an adapter tube in FIG. 1.

As shown in FIG. 12, the adapter tube 22 is a wide flat tube and there is a plurality of the adapter tubes, and the adapter tubes 22 are arranged in one-to-one correspondence with the adapter cavities. Since each adapter 21 is provided with six adapter cavities in this embodiment, there are also six adapter tubes 22, and two ends of each adapter tube 22 are respectively communicated with one adapter cavity on two adapters 21, so that the adapter cavities on the two adapters 21 are communicated in one-to-one correspondence.

Since the adapter cavity in this embodiment corresponds to the plurality of the first slots 2121, in order to guarantee smooth flow, each adapter tube 22 has a plurality of channels, and the channels of the same adapter tube 22 are communicated with the same adapter cavity. In this way, the circulation area of the adapter tube 22 is increased, and the smooth flow of the medium is guaranteed.

As shown in FIG. 8 to FIG. 11, similar to a partial structure of the adapter 21 of the intermediate adapter portion 20, the end adapter portion 30 includes a third plate 31 and a fourth plate 32, and the third plate 31 has a plurality of second convex hulls 311; and the fourth plate 32 has a plurality of second slots 321, while the third plate 31 fits the fourth plate 32, the second convex hulls 311 and the fourth plate 32 are enclosed into a plurality of communication cavities. A difference from the adapter 21 is that a function of the end adapter portion 30 is to communicate with the two superposed heat exchange tube groups 10. Therefore, the heat exchange tube groups 10 which are mutually superposed, namely the second heat exchange tube group 12 and the third heat exchange tube group 13 are both communicated with the communication cavity through the second slots 321, and the widths of the third plate 31 and the fourth plate 32 extend along the superposition direction of the heat exchange tube groups 10, namely the width direction is horizontal, and the second slots 321 are arranged along the width direction of the third plate 31, namely there is also a plurality of rows and columns of the second slots 321. There are also two columns of the second slots 321 in this embodiment, each of the second slots 321 arranged along the width direction of the third plate 31 corresponds to the same communication cavity, namely the second slots 321 in the same row are communicated with the same communication cavity. In this way, the medium in the second heat exchange tube group 12 flows into the third heat exchange tube group 13 through one second slot 321, the communication cavity, and another second slot 321 in the same row, as to achieve a change of a flow direction in the superposition direction.

In some embodiments, since the intermediate adapter portion 20 communicated with the first heat exchange tube group 11 and the second heat exchange tube group 12 is located outside the heat exchanger, and the intermediate adapter portion 20 communicated with the third heat exchange tube group 13 and the fourth heat exchange tube group 14 is located inside the heat exchanger, so along the length direction of the heat exchange tube group 10, the length of the intermediate adapter portion 20 for communicating the first heat exchange tube group 11 and the second heat exchange tube group 12 is greater than the length of the intermediate adapter portion 20 for communicating the third heat exchange tube group 13 and the fourth heat exchange tube group 14.

As shown in FIG. 1 and FIG. 2, the heat exchanger further includes a plurality of side plates 40, and two side plate 40 are respectively arranged above and below each heat exchange tube group 10. In this way, two side plates 40, the end adapter portion 30 and the intermediate adapter portion 20 are enclosed together into an accommodating area for accommodating the heat exchange tube groups 10, as to protect and isolate the heat exchange tube groups 10.

As shown in FIG. 1 to FIG. 3, the heat exchanger further includes a plurality of current collector tubes 50, an inlet tube 60 and an outlet tube 70, and the inlet tube 60 and the outlet tube 70 are respectively communicated with one heat exchange tube group 10 through the current collector tubes 50.

In some embodiments, the current collector tubes 50, the inlet tube 60 and the outlet tube 70 are located on the same side of the heat exchanger, and located on the side of the heat exchanger away from the end adapter portion 30. In this embodiment, two current collector tubes 50 which are circular are arranged, the two current collector tubes 50 are respectively connected with the ends of the first heat exchange tube group 11 and the fourth heat exchange tube group 14 away from the intermediate adapter portion 20, and the two current collector tubes 50 are respectively connected with the inlet tube 60 and the outlet tube 70. In this way, the medium is fed into the heat exchanger through the inlet tube 60, and the medium sequentially passes through the first heat exchange tube group 11, the intermediate adapter portion 20, the second heat exchange tube group 12, the end adapter portion 30, the third heat exchange tube group 13, the intermediate adapter portion 20, and the fourth heat exchange tube group 14 and flows out from the outlet tube 70, to form a U-shaped refrigerant flow path. While it passes through the first heat exchange tube group 11, the second heat exchange tube group 12, the third heat exchange tube group 13 and the fourth heat exchange tube group 14, the heat exchange is performed by heat exchange with a cold airflow. In some embodiments, the above flow direction may also be reversed.

In some embodiments, the heat exchange tube group 10 includes a heat exchange tube and a heat exchange fin connected with the heat exchange tube, in some embodiments, the heat exchange tube is a heat exchange flat tube, and the heat exchange fin accelerates the heat exchange between the medium and the cold airflow, as to improve the heat exchange effect. The specification of the heat exchange flat tube on the two superposed heat exchange tube groups 10 is adjusted according to the requirements, and may be the same or different, as to adapt to the different heat exchange working conditions.

It should be noted that the plurality in the above embodiments refers to at least two.

From the above descriptions, it can be seen that the above embodiments of the present application achieve the following technical effects.

1. The problem that the A-type heat exchanger in the technology known to inventors can not satisfy the use requirements is solved.
2. The heat exchange tube groups are superposed, so that the cold airflow can more fully exchange heat with the medium in the heat exchange tube groups, as to improve the heat exchange performance of the heat exchanger.
3. The intermediate adapter portion bends the heat exchange tube groups into the A-type structure, so that the heat exchanger has the advantages of drainage, compactness and high efficiency, and the heat exchanger can satisfy the use requirements of the users.
4. The specification of the heat exchange tube can be adjusted, and it may be the same or different, as to adapt to the different heat exchange working conditions.

Apparently, the above embodiments described are only a part of the embodiments of the present application, but not all of the embodiments. Based on the embodiments in the present application, all other embodiments obtained by those of ordinary skill in the art without creative work shall fall within a scope of protection of the present application.

The above are only preferred embodiments of the present application, and are not intended to limit the present application. For those skilled in the art, the present application may have various modifications and changes. Any modifications, equivalent replacements, improvements and the like made within the spirit and principle of the present application shall be included within the scope of protection of the present application.

What is claimed is:

1. A heat exchanger, comprising:

at least three heat exchange tube groups, wherein the heat exchange tube groups are communicated in sequence, and at least two heat exchange tube groups of the at least three heat exchange tube groups are superposed mutually along a direction in which a heat exchange airflow flows, a medium sequentially flows through each heat exchange tube group and forms a U-shaped trajectory;

an intermediate adapter portion, wherein the at least two heat exchange tube groups are communicated with each other by the intermediate adapter portion, the intermediate adapter portion comprises at least two adapters and an adapter tube communicated with the two adjacent adapters, wherein each adapter comprises a first plate and a second plate, the adapter tube is an extrusion-formed flat tube, and a width direction of the adapter tube is perpendicular to a width direction of the heat exchange tube groups; and an end adapter portion, wherein the end adapter portion is located at an end of heat exchange tube groups which are mutually superposed away from the intermediate adapter portion, and the heat exchange tube groups which are mutually superposed are communicated with each other by the end adapter portion.

2. The heat exchanger as claimed in claim 1, wherein the at least two adapters are respectively connected with mutually close ends of the two heat exchange tube groups communicated by the intermediate adapter portion.

3. The heat exchanger as claimed in claim 1, wherein the first plate has a plurality of first convex hulls, and each of the plurality of first convex hulls has a through hole; and the second plate has a plurality of first slots, the first plate fits the second plate, the first convex hulls and the second plate are enclosed into a plurality of mutually separated adapter cavities, the adapter tube is communicated with a corresponding adapter cavity through the through holes, and each heat exchange tube group is communicated with a corresponding adapter cavity through the first slots.

4. The heat exchanger as claimed in claim 3, wherein each of the at least three heat exchange tube groups comprises a plurality of heat exchange tubes arranged in sequence, lengths of the first plate and the second plate extend along an arrangement direction of the heat exchange tubes, at least part of the first slots are arranged along a length direction of the first plate and communicated with heat exchange tubes in a same heat exchange tube group of the at least three heat exchange tube groups, and the adapter cavities are disposed corresponding to at least one of first slots arranged along the length direction of the first plate.

5. The heat exchanger as claimed in claim 3, wherein an end of the heat exchange tube groups which are mutually superposed close to the intermediate adapter portion is connected with a same adapter, widths of the first plate and the second plate extend along a superposition direction of the heat exchange tube groups, at least part of the plurality of first slots are arranged along a width direction of the first plate, and first slots arranged along the width direction of the first plate corresponds to one adapter cavity respectively.

6. The heat exchanger as claimed in claim 3, wherein the adapter tube is a wide flat tube and there is a plurality of the adapter tubes, and the plurality of adapter tubes and the adapter cavities are arranged in one-to-one correspondence.

7. The heat exchanger as claimed in claim 3, wherein the adapter tube has a plurality of channels, and the plurality of channels of a same adapter tube is communicated with a same adapter cavity.

8. The heat exchanger as claimed in claim 1, wherein the end adapter portion comprises:

a third plate, wherein the third plate has a plurality of second convex hulls; and a fourth plate, wherein the fourth plate has a plurality of second slots, the third plate fits the fourth plate, the plurality of second convex hulls and the fourth plate are enclosed into a plurality of communication cavities, the heat exchange tube groups which are mutually superposed are communicated with the communication cavities through the second slots, widths of the third plate and the fourth plate extend along a superposition direction of the heat exchange tube groups, at least part of the plurality of second slots are arranged along a width direction of the third plate, and second slots arranged along the width direction of the third plate corresponds to a same communication cavity.

9. The heat exchanger as claimed in claim 1, wherein the heat exchanger further comprises a plurality of side plates, two side plates are respectively arranged above and below each heat exchange tube group, and the two side plates, one end adapter portion and one intermediate adapter portion are enclosed together into an accommodating area for accommodating heat exchange tube groups.

10. The heat exchanger as claimed in claim 1, wherein the heat exchanger further comprises:

a plurality of current collector tubes;

an inlet tube; and an outlet tube, wherein the inlet tube and the outlet tube are respectively communicated with one heat exchange tube group through the plurality of current collector tubes.

11. The heat exchanger as claimed in claim 10, wherein the plurality of current collector tubes, the inlet tube and the outlet tube are located on a same side of the heat exchanger, and located on a side of the heat exchanger away from the end adapter portion.

12. The heat exchanger as claimed in claim 1, wherein all the at least three heat exchange tube groups comprise:

a first heat exchange tube group;

a second heat exchange tube group;

a third heat exchange tube group; and a fourth heat exchange tube group, wherein the first heat exchange tube group, the third heat exchange tube group and the fourth heat exchange tube group are communicated in sequence, between the first heat exchange tube group and the fourth heat exchange tube group and between the second heat exchange tube group and the third heat exchange tube group, they are mutually superposed along a direction in which the airflow flows, and between the first heat exchange tube group and the second heat exchange tube group and between the third heat exchange tube group and the fourth heat exchange tube group, they are respectively communicated by the intermediate adapter portion.

13. The heat exchanger as claimed in claim 12, wherein along a length direction of the heat exchange tube groups, a length of an intermediate adapter portion for communicating the first heat exchange tube group and the second heat exchange tube group is greater than a length of an intermediate adapter portion for communicating third heat exchange tube group and the fourth heat exchange tube group.

14. The heat exchanger as claimed in claim 1, wherein the adapter tube is bent, and two heat exchange tube groups communicated by the intermediate adapter portion have an A-shaped structure.

* * * * *